US006130024A

United States Patent [19]

Aylward et al.

[11] Patent Number: 6,130,024

[45] Date of Patent: Oct. 10, 2000

[54] STRIPPABLE REPOSITIONABLE BACK SHEET FOR PHOTOGRAPHIC ELEMENT

[75] Inventors: Peter T. Aylward, Hilton; Robert P. Bourdelais, Pittsford; Thaddeus S. Gula, Rochester; Robert F. Cournoyer, Webster, all of N.Y.

[73] Assignee: Eastman Kodak Company, Rochester, N.Y.

[21] Appl. No.: 09/197,730

[22] Filed: Nov. 20, 1998

[51] Int. Cl.[7] ..... G03C 1/805; G03C 8/52; G03C 11/12

[52] U.S. Cl. ..... 430/256; 430/97; 430/124; 430/207; 430/259; 430/262; 430/263; 430/201; 430/212; 430/432; 430/512; 430/523; 430/536; 430/961; 347/106; 503/227

[58] Field of Search ..... 430/256, 259, 430/262, 263, 961, 207, 432, 212, 201, 523, 512, 536, 97, 124; 347/106; 503/227

[56] References Cited

U.S. PATENT DOCUMENTS

| | | | |
|---|---|---|---|
| 2,391,171 | 12/1945 | Lane | 430/259 |
| 3,149,973 | 9/1964 | Winchell | 430/263 |
| 3,168,402 | 2/1965 | Branibar | 430/262 |
| 3,183,092 | 5/1965 | Mackey et al. | 430/263 |
| 3,359,107 | 12/1967 | Goffe et al. | 430/263 |
| 4,409,316 | 10/1983 | Zeller-Pendley et al. | 430/263 |
| 4,778,782 | 10/1988 | Ito et al. | 503/227 |
| 4,971,950 | 11/1990 | Kato et al. | 503/227 |
| 5,397,634 | 1/1995 | Kuroda et al. . | |
| 5,466,519 | 11/1995 | Shirakura et al. | 430/538 |
| 5,514,460 | 5/1996 | Surman et al. | 428/304.4 |
| 5,853,965 | 12/1998 | Haydock et al. | 430/536 |
| 5,866,282 | 2/1999 | Bourdelais et al. | 430/536 |
| 5,874,205 | 2/1999 | Bourdelais et al. | 430/536 |
| 5,955,239 | 9/1999 | Haydock et al. | 430/263 |

FOREIGN PATENT DOCUMENTS

| | | |
|---|---|---|
| 0 111 031 | 6/1984 | European Pat. Off. . |
| 0 812 699 | 12/1997 | European Pat. Off. . |
| 0 880 065 A1 | 11/1998 | European Pat. Off. . |
| 0 880 067 A1 | 11/1998 | European Pat. Off. . |
| 0 880 069 A1 | 11/1998 | European Pat. Off. . |
| 64-01078251 | 3/1989 | Japan . |
| 64-01191139 | 8/1989 | Japan . |
| 5-5249615 | 9/1993 | Japan . |
| 2 325 749 | 12/1998 | United Kingdom . |
| 2 325 750 | 12/1998 | United Kingdom . |

OTHER PUBLICATIONS

Patent Abstracts of Japan, Publication No. 01078251, Mar. 1989.

Patent Abstracts of Japan, Publication No. 01191139, Aug. 1989.

Patent Abstracts of Japan, Publication No. 05249615, Sep. 1993.

*Primary Examiner*—Richard L. Schilling
*Attorney, Agent, or Firm*—Paul A. Leipold

[57] ABSTRACT

The invention relates to an imaging element comprising support having adhered to the backside a strippable polymer layer that when removed has an adhesive layer thereon.

35 Claims, No Drawings

STRIPPABLE REPOSITIONABLE BACK SHEET FOR PHOTOGRAPHIC ELEMENT

FIELD OF THE INVENTION

This invention relates to photographic materials. In the preferred form it relates to base materials for photographic prints.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. While the polyethylene does provide waterproofness to the paper, the melt extruded polyethylene layer on the backside of color paper has very little dimensional strength and cannot be removed. It has little utility other than to provide a balance package for curl and provide a degree of waterproofness. In conventional photographic products there is an overcoat which is primarily gelatin on top of the photosensitive layers. The overcoat provides a level of protection to help minimize scratches. It typically is a gelatin based material but also may contain other synthetic polymers, but needs to be water permeable to allow the processing chemistries to get into the photosensitive layers. Since it is water permeable, it offers little or no protection to the final image against spills or damage from liquids. Even small drops of water spilt on the surface of a photograph can ruin the image and value of the print.

It has been proposed in U.S. Pat. No. 5,244,861 to utilize biaxially oriented polypropylene in receiver sheets for thermal dye transfer. In U.S. Pat. No. 5,244,861 high strength biaxially oriented sheets are laminated to cellulose paper with low density polyethylene. These layers provide functionality to the imaging material, but they do not protect the image which is on top of the top side sheet.

In current photographic papers, the backside polymer layer is attached for the life of the print. Polyethylene is placed on each side of the paper to prevent processing chemical from wetting the paper base which would require long drying times for photoprocessing. Photographic paper is generally viewed and handled by the consumer and either displayed or stored in albums. Problems sometimes occur with fingerprints and scratches on the image side or even spills of liquids on the image surface which can render the print unusable or displeasing. Other types of protection other than the protection from physical damage would include the need to shield the image dyes and pigments from UV light which can cause dyes to fade or even cracking with long-term exposure. Also a method of protecting the image from atmospheric gases such as oxygen, nitrous oxide, and other harmful gases that may ruin the image would be helpful.

PROBLEM TO BE SOLVED BY THE INVENTION

There is a need to protect imaging materials and provide added features to an image.

SUMMARY OF THE INVENTION

It is an object of the invention to provide an imaging material that overcomes disadvantages of present products.

It is another object to have an adhesive on the strippable polymer layer.

It is an additional object to provide a method and an imaging element that provides protection to the image.

These and other objects of the invention are accomplished by an imaging element comprising a support having an image forming layer thereon and adhered to the back of said support a strippable polymer sheet that, when removed, has an adhesive layer thereon.

ADVANTAGEOUS EFFECT OF THE INVENTION

The invention provides imaging print elements having a strippable polymer and adhesive layer on the backside that is used to provide additional improvements to the imaging element. The backside strippable layer may be removed and applied to the front as a protective layer.

DETAILED DESCRIPTION OF THE INVENTION

The invention has numerous advantages over prior practices in the art. The invention provides an imaging element that has a polymer layer on the backside of said element that is strippable and has an adhesive attached to the polymer layer after it is removed. Once the backside removable polymer sheet with the attached adhesive is removed, it is applied over the image to provide protection and or added functionality to the imaging element. Such a sheet would offer protection from physical damage such as scratches and spills of liquid materials. In addition, such a polymer sheet would offer protection from damaging effects of UV light exposure and atmospheric gases which can cause the image to fade or craze, or the polymer layer under the image to crack. A sheet designed with a fine line or pattern of dots would offer security protection of the image from copying. Such an element has significant commercial value. Further, the invention provides an imaging element that has added functionality over traditional imaging elements. Another advantage is that the layer that is stripped and has an adhesive on it can be applied to the image side of the imaging element to provide a protective layer that adds significant life and durability to the image. The strippable polymer layer, when applied over the image, provides a spill resistant layer to the image. Without such a layer, the image could be damaged and would lose its commercial value and appeal to the owner. A further advantage is that said strippable polymer with adhesive when applied over an image can provide protection from the harmful affects of light and, in particular, UV light on the image layer. In order to sufficiently protect prints from damage in the normal course of their viewing, it would be desirable to have an imaging base material that has adhered to the backside a strippable polymer sheet that, when removed, has an adhesive layer thereon. An additional advantage is that the strippable layer, when applied over the image side, could provide a matte or texture affect to the image, thereby enhancing its commercial value and versatility. These and other advantages will be apparent from the detailed description below.

A further embodiment of this invention is an imaging element comprising a support having an image on the top side and a strippable polymer sheet adhered to the back of the support that, when removed, has an adhesive layer thereon. In another embodiment when the strippable polymer sheet is removed, a layer of adhesive remains on the imaging element, as well as the strippable polymer sheet. This type of element can then be adhesive mounted to another substrate for display or other purpose while placing the strippable polymer sheet over the image to provide protection to the image.

The terms as used herein, "top", "upper", "emulsion side", and "face" mean the side or towards the side of an imaging member bearing the imaging layers or developed image. The terms "bottom", "lower side", and "back" mean the side or towards the side of the imaging member opposite from the side bearing the imaging layers or developed image. The term "tie layer" as used herein refers to a layer of material that is used to adhere biaxially oriented sheets to a base such as paper, polyester, fabric, or other suitable material. The term "strippable polymer sheet" refers to a layer that is initially attached to the backside of the imaging element and that can be removed from the imaging element and there is an adhesive attached to the polymer sheet that has been removed.

Any suitable polymer may be used for the strippable (peelable) polymer sheet. Polyolefins, polyesters, polyamides, and others may be used. It is useful to have a polymer layer that does not stretch or has minimal yield to the sheet as a force is applied to remove it from the backside. Polymers that are oriented in at least one direction are the most effective in minimizing stretch and have the greatest versatility in adding additional functionality to an imaging element.

The imaging element of the embodiments comprises a support having an image forming layer, and on the backside of said element there is adhered a strippable polymer sheet that, when removed, has an adhesive layer attached to it. This structure provides greater versatility than traditional imaging materials in that it provides methods for forming a protected image. The polymer sheet that has been removed can then be reapplied over the image to help protect the image from handling damage, scratches, spills, exposure to environmental gases such as oxygen, harmful oxides that can degrade imaging materials, and harmful exposure to UV or other radiation sources. These problems may render an image useless or, at best, significantly reduce its value. In the embodiment described above, when the polymer layer is removed from the backside of the imaging element, it can also expose a writable surface that can easily accept indicia as applied by any means known in the art such as pencils, ballpoint pens, water based pen, felt marker, or ink from ink jet printers. In one of the preferred embodiments of this invention the strippable polymer sheet is transparent. The advantage of a transparent or substantially transparent sheet is that it can be applied over the image to provide protection to the image without viewing interference. Such an application has significant commercial value in that the print is fully protected and further broadens the range of conditions in which the print can be used without damage to the image. A matte or textured surface may also be incorporated in or on the strippable polymer sheet. When this is done, additional commercial value is achieved because the final end user can choose to either leave the image as a glossy surface or apply a matte or textured sheet to convert the image to a non-glossy surface. Special visual effects may be achieved by having a strippable backside polymer sheet that has unique patterns such as a border pattern, an artistic brush-stroke pattern, a fine line pattern that would render the print to be copy proof using a digital scanner or photocopying system, or other patterns known in the art. There are numerous other patterns and methods to achieve a non glossy surface known in the art.

One of the preferred strippable polymer layers in the imaging element comprises a laminated support comprising a paper having a biaxially oriented polyolefin sheet adhere to each side. In a further embodiment the strippable polymer layer comprises a polyolefin and or polyester. These polymers provide excellent stretch resistance when the polymer sheet is being removed from the backside. Good stretch resistance is an important feature of the strippable polymer sheet such that the sheet is not deformed or enlarged and is, therefore, larger than the print element. In this case the repositioned sheet would overhang an edge of the print after it is applied to the imaged side. This would create an unpleasing appearance to the customer. The selection of a suitable polymer provides a method of forming an image comprising providing an imaging element comprising a support having an image thereon and adhered to the back of said support a strippable polymer sheet that, when removed, has an adhesive layer thereon and enables the stripping of said strippable polymer sheet.

The present invention provides multilayered sheets of biaxially oriented polymer which are attached to both the top and bottom of a photographic quality paper support by melt extrusion of a polymer tie layer. Oriented polymer sheets are generally preferred in this invention because of their high strength properties and resistance to yielding when placed under a load. These properties are important to reduce curl in the final product, as well as providing a repositionable sheet that does not stretch when removed from the backside. Any suitable biaxially oriented polymer sheet may be used for the sheet on the top side of the laminated base used in the invention. Microvoided composite biaxially oriented sheets are preferred and are conveniently manufactured by coextrusion of the core and surface layers, followed by biaxially orientation, whereby voids are formed around void-initiating material contained in the core layer. Such composite sheets may be formed as in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density", is calculated as follows:

$$\frac{\text{Composite Sheet Density}}{\text{Polymer Density}} \times 100 = \%\ \text{of Solid Density}$$

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 $\mu$m, preferably from 20 to 70 $\mu$m. Below 20 $\mu$m, the microvoided sheets may not be thick enough to minimize any inherent non-planarity in the support and would be more difficult to manufacture. At thickness higher than 70 $\mu$m, little improvement in either surface smoothness or mechanical properties are seen, and so there is little justification for the further increase in cost for extra materials.

The biaxially oriented sheets that have been used in this invention may contain a plurality of layers in which at least one of the layers contains voids. The voids provide added opacity to the imaging element. This voided layer can also be used in conjunction with a layer that contains at least one pigment from the group consisting of $TiO_2$, $CaCO_3$, clay, $BaSO_4$, ZnS, $MgCO_3$, talc, kaolin, or other materials that provides a highly reflective white layer in said film of more than one layer. The combination of a pigmented layer with a voided layer provides additional advantages in the optical performance of the final imaging element. The imaging element may have either a photographic silver halide and dye forming coupler emulsion or an image receiving layer typically used for thermal dye sublimation or ink jet.

"Void" is used herein to mean devoid of added solid and liquid matter, although it is likely the "voids" contain gas and void initiating particles. The void-initiating particles which remain in the finished packaging sheet core should be from 0.1 to 10 $\mu$m in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells and, thus, there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred, and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene, and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization and limited coalescence directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, and calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins. Suitable polyolefins include polypropylene, polyethylene, polymethylpentene, polystyrene, polybutylene, and mixtures thereof. Polyolefin copolymers, including copolymers of propylene and ethylene, such as hexene, butene, and octene are also useful. Polypropylene is preferred, as it is low in cost and has desirable strength properties. Polyesters, polyamides, and other polymer can be also be used.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers, while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 or more layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability, coating polyvinylidene chloride for heat seal properties. Further examples include flame, plasma, or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a typical biaxially oriented sheet of the invention is as follows:

| |
|---|
| Solid top skin layer |
| Core layer |
| Solid skin layer |

The sheet on the side of the base paper opposite to the emulsion layers may be any suitable sheet. The sheet may or may not be microvoided. It may have the same composition as the sheet on the top side of the paper backing material. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425, the disclosure of which is incorporated by reference.

The preferred biaxially oriented sheet is a biaxially oriented polyolefin sheet, most preferably a sheet of polyethylene or polypropylene. The thickness of the biaxially oriented sheet should be from 10 to 150 $\mu$m. Below 15 $\mu$m, the sheets may not be thick enough to minimize any inherent non-planarity in the support and would be more difficult to manufacture. At thickness higher than 70 $\mu$m, little improvement in either surface smoothness or mechanical properties are seen, and so there is little justification for the further increase in cost for extra materials.

The biaxially oriented sheets of the invention preferably have a water vapor permeability that is less than $0.85\times10$ g/mm$^2$/day. This allows faster emulsion hardening, as the laminated support of this invention greatly slows the rate of water vapor transmission from the emulsion layers during coating of the emulsions on the support. The transmission rate is measured by ASTM F1249.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols, and mixtures thereof. Such polyesters are well known in the art and may be produced by well-known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with layers of the same polymeric material, or it can be made with layers of different polymeric composition. For compatibility, an auxiliary layer can be used to promote adhesion of multiple layers.

Addenda may be added to the biaxially oriented back side sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers, while restraining to some degree the sheet against retraction in both directions of stretching.

The biaxially oriented sheet on the backside of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion or look to the support and photographic element. The biaxially oriented extrusion could be carried out with as many as 10 layers if desired to achieve some particular desired property.

These biaxially oriented sheets may be coated or treated after the coextrusion and orienting process or between casting and full orientation with any number of coatings, which may be used to improve the properties of the sheets including printability, to provide a vapor barrier, to make them heat sealable, or to improve the adhesion to the support or to the photosensitive layers. Examples of this would be acrylic coatings for printability and coating polyvinylidene chloride for heat seal properties. Further examples include flame, plasma, or corona discharge treatment to improve printability or adhesion.

The structure of a typical biaxially oriented sheet that may be laminated to the bottom side of the imaging elements with the core layer towads the top is as follows:

| |
|---|
| treated skin layer |
| solid core layer |

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312; and 5,055,371.

The preferred support is a photographic grade cellulose fiber paper. When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an adhesive between them, followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheets in order to minimize curl in the resulting laminated support. For high humidity applications (>50% RH) and low humidity applications (<20% RH), it is desirable to laminate both a front side and back side film to keep curl to a minimum.

The surface roughness of this invention can also be accomplished by laminating a biaxially oriented sheet to a paper base that has the desired roughness. The roughness of the paper base can be accomplished by any method known in the art such as a heated impression nip or a press felt combined with a roller nip in which the rough surface is part of the press nip. The preferred roughness of the base paper is from 35 $\mu$m to 150 $\mu$m. This preferred range is larger than roughness range for the imaging support because of the loss of roughness that occurs in melt extrusion lamination.

In one preferred embodiment, in order to produce photographic elements with a desirable photographic look and feel, it is preferable to use relatively thick paper supports (e.g., at least 120 mm thick, preferably from 120 to 250 mm thick) and relatively thin microvoided composite sheets (e.g., less than 50 mm thick, preferably from 20 to 50 mm thick, more preferably from 30 to 50 mm thick).

In the present invention, the backside of the substrate is permanently laminated with a biaxially oriented sheet of polymer that is joined to the base substrate with an adhesive. A second strippable and repositionable biaxially oriented sheet that is transparent is applied on the back of the laminated substrate with a peelable repositionable adhesive. The strippable second sheet is pressure laminated to the bottom side of the first bottom sheet with the adhesive between the strippable sheet and the permanent bottom sheet. While strippable polymer layers that are directly extruded to the base substrate may be used, the biaxially oriented sheets are preferred because of their high strength properties and their ability to resist dimensional change. It is important to be able to balance the overall curl properties of the final imaged structure. Again, biaxially oriented sheets are best for this application because of the ability to align strength properties of the base and polymer sheets.

Any suitable biaxially oriented polymer sheet may be used for the transparent peelable or repositionable sheet that is applied to the backside of the laminated imaging element. Biaxially oriented sheets are conveniently manufactured by coextrusion of the sheet, which may contain several layers, followed by biaxially orientation. Such biaxially oriented sheets are disclosed in, for example, U.S. Pat. No. 4,764,425.

Preferred classes of thermoplastic polymers for the biaxially oriented repositionable sheet include polyolefins, polyesters, polyamides, polycarbonates, cellulosic esters, polystyrene, polyvinyl resins, polysulfonamides, polyethers, polyirnides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Preferred polyolefins include polypropylene, polyethylene, polymethylpentene, and mixtures thereof. Polyolefin copolymers, including copolymers of propylene and ethylene such as hexene, butene, and octene are also useful. Polypropylenes are preferred because they are low in cost and have good strength and surface properties.

Preferred polyesters include those produced from aromatic, aliphatic or cycloaliphatic dicarboxylic acids of 4–20 carbon atoms and aliphatic or alicyclic glycols having from 2–24 carbon atoms. Polyesters are preferred because these polymers have a high modulus and resist stretching when they are removed from the backside and applied over the image. Polymer sheets made from polyesters are also very durable during handling, as well as providing a high degree of gloss to the final product. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols, and mixtures thereof. Such polyesters are well known in the art and may be produced by well-known techniques, e.g., those described in U.S. Pat. Nos. 2,465,319 and U.S. Pat. No. 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The repositionable biaxially oriented sheet on the backside of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion or look to the support and photographic element. The biaxially oriented extrusion could be carried out with as many as 10 layers if desired to achieve some particular desired property.

The preferred thickness of the repositionable sheet of this invention is between 6 to 100 $\mu$m. Below 4 $\mu$m the web is difficult to convey through manufacturing, and the photographic printers and its strength properties are sufficiently low to cause problems when being repositioned. Above 120 $\mu$m, there is little benefit to justify the additional material costs.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability and a coating polyvinylidene chloride for heat seal properties. Further examples include flame, plasma or corona discharge treatment to improve printability or adhesion.

In the imaging markets it is often desirable to have a border or frame appearance around the finished print. In a further embodiment, the strippable sheet comprises a substantially transparent sheet having a border design. This allows the end user to peel off the backside polymer layer and overlay it on the imaged side with a border. This provides the end user with added value and versatility with imaging media. If the backside polymer sheet has an oxygen barrier of less than 2 cc/m$^2$/atm/day and it is removed from the backside and repositioned over the image, it provides protection for the image dyes that may be prone to fading or discoloration over time with exposure to oxygen or other environmental gases such as nitroxal that can cause yellow edge if a phenolic based antioxidant is present. In one preferred embodiment an imaging element comprises a support having an image forming layer on the front side and adhered to the back of the support a strippable polymer sheet. The strippable sheet contains ultraviolet absorbers and when removed has an adhesive thereon. When removed polymer sheet is applied over the image on the top side, the sheet provides protection to the image by providing a filter to screen out harmful UV light that can degrade the dyes and render the print material less than desirable, therefore reducing its value. Another embodiment utilizes a strippable backside polymer sheet that comprises the polymer sheet or the adhesive for the sheet that contains optical brightener or tinting compounds. This would provide a method and sheet that, when applied over the image, would improve the optical performance of the final print. The optical brighteners being located above the final image would have improved efficiency for providing whiter whites.

Preferred Imaging Element with Repositionable Back Sheet

Image layer
Oriented Polymer Layer
Permanent Polymer layer
Raw Stock / Base Substrate
Permanent Polymer layer
Oriented Polymer Layer
Repositionable Adhesive layer

|Removable Polymer layer|

Imaging Element After with Repositionable back Sheet Applied to the Image

-continued

| |Removable Polymer layer| |
|---|---|
| Repositionable Adhesive layer | |
| Image layer | |
| Oriented Polymer Layer | |
| Permanent Polymer layer | |
| Raw Stock / Base Substrate | |
| Permanent Polymer layer | |
| Oriented Polymer Layer | |

The laminated base may comprise a release layer for said adhesive that repositions is preferred. The release layer allows for uniform separation of the adhesive at the adhesive substrate interface. The release layer for the peelable adhesive may be applied by any method known in the art for applying a release layer to substrates. Examples include a silicon coatings, tetrafluoroethylene flurocarbon coatings, fluorinated ethylene-propylene coatings and calcium stearate.

Suitable peelable adhesives of this invention must not interact with the light sensitive silver halide imaging system so that image quality is deteriorated. Further, since photographic elements of this invention must be photoprocessed, the performance of the adhesive of this invention must not be deteriorated by photographic processing chemicals. Suitable adhesive may be inorganic or organic, natural or synthetic, that is capable of bonding the image to the desired surface by surface attachment. Examples of inorganic adhesives are soluble silicates, ceramic and thermosetting powdered glass. Organic adhesives may be natural or synthetic. Examples of natural organic adhesives include bone glue, soybean starch cellulosics, rubber latex, gums, terpene, mucilages and hydrocarbon resins. Examples of synthetic organic adhesives include elastomer solvents, polysulfide sealants, theromplastic resins such as isobutylene and polyvinyl acetate, theromsetting resins such as epoxy, phenoformaldehyde, polyvinyl butyral and cyanoacrylates and silicone polymers.

The preferred peelable and repositionable adhesive composition is selected from the group consisting of natural rubber, syntheic rubber, acrylics, acrylic copolymers, vinyl polymers, vinyl acetate-, urethane, acrylate- type materials, copolymer mixtures of vinyl chloride-vinyl acetate, polyvinylidene, vinyl acetate-acrylic acid copolymers, styrene butadiene, carboxylated stryrene butadiene copolymers, ethylene copolymers, polyvinyl alcohol, polyesters and copolymers, cellulosic and modified cellulosic, starch and modified starch compounds, epoxies, polyisocyanate, polyimides.

Water based pressure sensitive adhesion provides the manufacturing process advantage of nonsolvent emissions. Repositionable peelable adhesive containing non-adhesive solid particles randomly distributed in the adhesive layer aids in the ability to stick and then remove the print to get the desired end result. The most preferred pressure sensitive peelable adhesive is a respositionable adhesive layer containing at about 5% to 20% by weight of a permanent adhesive such as isooctyl acrylate/acrylic acid copolymer and at about 95% to 80% by weight of a tacky elastomeric material such as acrylate microspheres with the adhesive layer coverage at about 5 to 20 g/m$^2$.

The preferred peelable adhesive materials may be applied using a variety of methods known in the art to produce thin, consistent adhesive coatings. Examples include gravure coating, rod coating, reverse roll coating and hopper coating. The adhesives may be coated on the biaxially oriented sheets of this invention prior to lamination or may be used to laminate the biaxially oriented sheets to the paper.

In order to provide promotions or contests linked to imaging media in which there is a hidden message or coupon, the strippable backside polymer layer of an imaging element would be substantially opaque to hide indicia located under the polymer layer such that when it is stripped off, the indicia is then exposed. The indicia could appear on the remaining imaged support or, in the preferred case, on the stripped polymer sheet. This would have great commercial value and interest to people that like to play contest or a coupon that offers a discount.

A further embodiment of this invention is a method of forming an image comprising an imaging element comprising a support with a backside strippable polymer layer with an adhesive thereon that when the strippable polymer layer is removed, a magnetically readable and recordable indicia is exposed. This embodiment provides an imaged material that also has the ability to record data or even voice. Being located on the imaging element under a polymer layer provides protection to the magnetic indicia from scratching and abrasion until it is ready for use. Magnetic indicia is very prone to scratches because it is typically very soft unless there is a hardened overcoat or protective layer.

As used herein the phrase "imaging element" is a material that may be used as a laminated support for the transfer of images to the support by techniques, such as ink jet printing or thermal dye transfer, as well as a support for silver halide images. As used herein, the phrase "photographic element" is a material that utilizes photosensitive silver halide in the formation of images. In the case of thermal dye transfer or ink jet, the image layer that is coated on the imaging element may be any material that is known in the art such as gelatin, pigmented latex, polyvinyl alcohol, polycarbonate, polyvinyl pyrrolidone, starch, and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 A1 (Yamada), and EP 0 435355 A1 (Makino).

The photographic elements of this invention may use emulsions doped with Group VIII metals such as iridium, rhodium, osmium, and iron as described in *Research Disclosure*, September 1996, Item 38957, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

In the following Table, reference will be made to (1) *Research Disclosure*, December 1978, Item 17643, (2) *Research Disclosure*, December 1989, Item 308119, and (3) Research Disclosure, September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 | I, II, III, IX A & B | hardeners, coating aids, addenda, etc. |
| 1 | III, IV | Chemical sensitization and |
| 2 | III, IV | spectral sensitization/ |
| 3 | IV, V | desensitization |
| 1 | V | UV dyes, optical |
| 2 | V | brighteners, luminescent |
| 3 | VI | dyes |
| 1 | VI | Antifoggants and |
| 2 | VI | stabilizers |

-continued

| Reference | Section | Subject Matter |
|---|---|---|
| 3 | VII | |
| 1 | VIII | Absorbing and scattering |
| 2 | VIII, XIII XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, X rays, alpha particle, neutron radiation, and other forms of corpuscular and wavelike radiant energy in either noncoherent (random phase) forms or coherent (in phase) forms, as produced by lasers. When the photographic elements are intended to be exposed by X rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The laminated substrate of the invention may have copy restriction features incorporated such as disclosed in U.S. application Ser. No. 08/598,785 filed Feb. 8, 1996 and U.S. Pat. No. 5,752,152. These applications disclose rendering a document copy restrictive by embedding into the document a pattern of invisible microdots. These microdots are, however, detectable by the electro-optical scanning device of a digital document copier. The pattern of microdots may be incorporated throughout the document. Such documents may also have colored edges or an invisible microdot pattern on the backside to enable users or machines to read and identify the media. The media may take the form of sheets that are capable of bearing an image. Typical of such materials are photographic paper and film materials composed of polyethylene resin coated paper, polyester, (poly) ethylene naphthalate, and cellulose triacetate based materials.

The microdots can take any regular or irregular shape with a size smaller than the maximum size at which individual microdots are perceived sufficiently to decrease the usefulness of the image, and the minimum level is defined by the detection level of the scanning device. The microdots may be distributed in a regular or irregular array with center-to-center spacing controlled to avoid increases in document density. The microdots can be of any hue, brightness, and saturation that does not lead to sufficient detection by casual observation, but preferably of a hue least resolvable by the human eye, yet suitable to conform to the sensitivities of the document scanning device for optimal detection.

In one embodiment the information-bearing document is comprised of a support, an image-forming layer coated on the support and pattern of microdots positioned between the support and the image-forming layer to provide a copy restrictive medium. Incorporation of the microdot pattern into the document medium can be achieved by various printing technologies either before or after production of the original document. The microdots can be composed of any colored substance, although depending on the nature of the document, the colorants may be translucent, transparent, or opaque. It is preferred to locate the microdot pattern on the support layer prior to application of the protective layer, unless the protective layer contains light scattering pigments. Then the microdots should be located above such layers and preferably coated with a protective layer. The microdots can be composed of colorants chosen from image dyes and filter dyes known in the photographic art and dispersed in a binder or carrier used for printing inks or light sensitive media.

In a preferred embodiment the creation of the microdot pattern as a latent image is possible through appropriate temporal, spatial, and spectral exposure of the photosensitive materials to visible or nonvisible wavelengths of electromagnetic radiation. The latent image microdot pattern can be rendered detectable by employing standard photographic chemical processing. The microdots are particularly useful for both color and black-and-white image-forming photographic media. Such photographic media will contain at least one silver halide radiation sensitive layer, although typically such photographic media contain at least three silver halide radiation sensitive layers. It is also possible that such media contain more than one layer sensitive to the same region of radiation. The arrangement of the layers may take any of the forms known to one skilled in the art, as discussed in *Research Disclosure* 37038 of February 1995.

EXAMPLES

The following examples illustrate the practice of this invention. They are not intended to be exhaustive of all possible variations of the invention. Parts and percentages are by weight unless otherwise indicated.

Commercial Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish is added 0.2% alkyl ketene dimer, 1.0% cationic cornstarch, 0.5% polyamide-epichlorohydrin, 0.26 anionic polyacrylamide, and 5.0% $TiO_2$ on a dry weight basis. An about 227g/$m^2$ bone dry weight base paper is made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base is then surface sized using a vertical size press with a 10% hydroxyethylated cornstarch solution to achieve a loading of 3.3 wt. % starch. The surface sized support is calendered to an apparent density of 1.04 gm/cc.

Example 1

The following laminated photographic base is prepared by extrusion laminating the following sheets to both the top and bottom sides of a photographic grade of cellulose paper support:

Oriented Polymer Layers: L2, L3, L4, &5 (Directly under Emulsion)

A composite sheet (38 μm thick) with a density of 0.75 g/cc consisting of a microvoided and biaxially oriented polypropylene core (approximately 70% of the total sheet thickness) in which the void initiating material is polybutylene terephalate (LA), with a $TiO_2$ pigmented nonvoided layer (L3) on the emulsion side and layer of solid nonpigmented polypropylene on the nonemulsion side (L5). In addition there is a thin skin layer of polyethylene (L2) on top of the $TiO_2$ layer (L3) to provide improved adhesion of the photographic emulsion to the support. This layer is in direct contact with the silver halide emulsion. The composite sheet is then extrusion laminated to the photographic paper base with a layer of 9.8g/$m^2$ of a blend of low density polyethylene and a metallocene catalyzed ethylene plastomer (Permanent Polymer Layer L6).

FIG. 1

| | |
|---|---|
| L1: | Photo Sensitive layer (Coating Format #1) |
| L2: | Thin Skin of Polyethylene |
| L3: | TiO2 in Polypropylene |
| L4: | Voided Core of Polypropylene |
| L5: | Solid Layer of Polypropylene |
| L6: | Permanent Polymer Layer (LDPE) |
| L7: | Photographic Paper Raw Stock |
| L8: | Permanent Polymer Layer (LDPE) |
| L9: | Oriented Polymer Layer (Polypropylene) |
| L10: | Repositionable Adhesive |
| L11: | Removable Polymer Layer |

Bottom Side (Side Opposite to the Emulsion)

A layer of low density (0.923 g/cc) polyethylene (L8) purchased from Eastman Chemical is extrusion coated onto the backside of a photographic paper base (L7) at 10 g/$m^2$. At the same time a clear biaxially oriented film of polypropylene (L9) that is approximately 15 μm thick is laminated to the L8 layer. A small amount of a lubricant (3000 ppm of Fluoropolymer was added to L9 prior to orientation to aid in the release of the repositionable adhesive.).

A transparent sheet of biaxially oriented polypropylene (L11) of approximately 0.7 mils is coated on one side with a pressure sensitive adhesive (L10) and is then applied to L9 with a hot roll lamination nip. Water based pressure sensitive adhesion provide some advantages for the manufacturing process such as nonsolvent emissions. Repositionable pressure sensitive adhesive containing nonadhesive solid particles randomly distributed in the adhesive layer aids in the ability to stick and then remove the print to get the desired end result. A pressure sensitive respositionable adhesive layer containing at about 12% by weight of a permanent adhesive (isooctyl acrylate/acrylic acid copolymer) and at about 88% by weight of a tacky elastomeric material (acrylate microspheres) was applied at an adhesive layer coverage 14 g/$m^2$.

The composite sheet is then emulsion coated with a silver halide photographic emulsion as described in coating format 1 (L1). The above photographic element was exposed and an image developed by processing using standard photographic methods. The removal backside polymer layer and repositionable adhesive was removed from the backside and applied over the image in a manner such that the clear adhesive was in contact with the image and the polymer sheet was uppermost in the completed structure. See assemble structure below.

FIG. 2
Structure After Applying Repositionable Polymer and Adhesive to the Image

| | |
|---|---|
| L11: | Removable Polymer Layer |
| L10: | Repositionable Adhesive |
| L1: | Photo Sensitive layer (Processed/developed image) |
| L2: | Thin Skin of Polyethylene |
| L3: | $TiO_2$ in Polypropylene |
| L4: | Voided Core of Polypropylene |
| L5: | Solid Layer of Polypropylene |
| L6: | Permanent Polymer Layer (LDPE) |
| L7: | Photographic Raw Stock |
| L8: | Permanent Polymer Layer (LDPE) |
| L9: | Oriented Polymer Layer (Polypropylene) |

Once the removed polymer layer with the repositionable adhesive was applied over the image, the print was subjected to the application of liquids. Several drops of tap water, coffee, and even a carbonated cola were applied to the top of the protective polymer layer. The liquids were left for several hours without damage to the image. Further tests were run in which print structure of FIG. 2 was handled excessively to diliberately apply fingerprints. A tissue was then used to wipe the fingerprint oils off the surface without damage to the image.

| | Coating Format 1 | Laydown mg/$m^2$ |
|---|---|---|
| Layer 1 | Blue Sensitive Layer | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive | |
| | Gelatin | 1100 |
| | Green sensitive silver | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive Layer | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |

-continued

| | Coating Format 1 | Laydown mg/m$^2$ |
|---|---|---|
| Layer 6 | UV Overcoat | |
| | Gelatin | 440 |
| | UV-1 | 20 |
| | UV-2 | 110 |
| | SC-1 | 30 |
| | S-3 | 20 |
| | S-1 | 20 |
| Layer 7 | SOC | |
| | Gelatin | 490 |
| | SC-1 | 17 |
| | $SiO_2$ | 200 |
| | Surfactant | 2 |

APPENDIX

Y-1

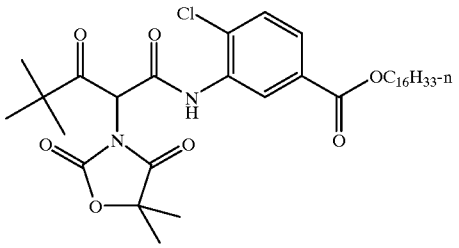

ST-1 = N-tert-butylacrylamide/n-butyl acrylate copolymer (50:50)

S-1 = dibutyl phthalate

SC-1

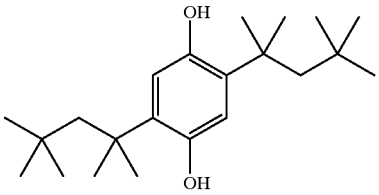

M-1

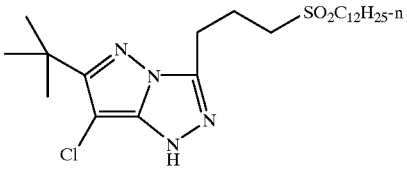

S-2 = diundecyl phthalate

ST-2

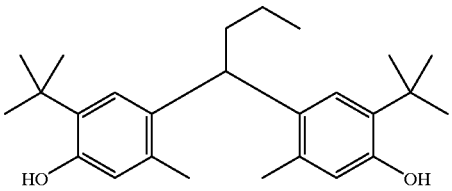

ST-3

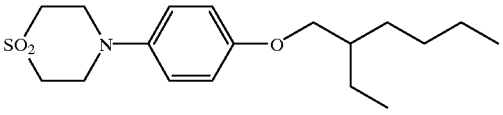

-continued

ST-4

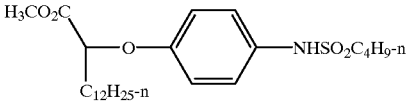

UV-1

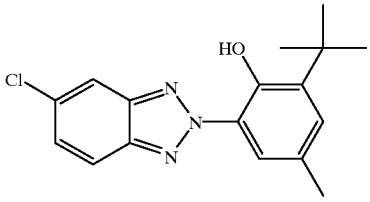

UV-2

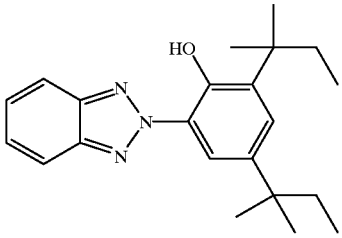

S-3 = 1,4-Cyclohexyldimethylene bis(2-ethylhexanoate)

C-1

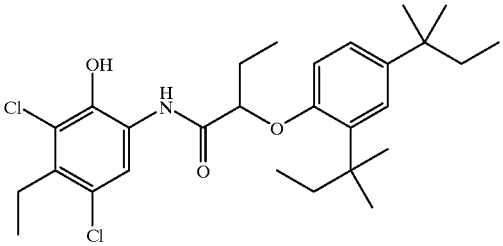

S-4 = 2-(2-Butoxyethoxy)ethyl acetate

Dye 1

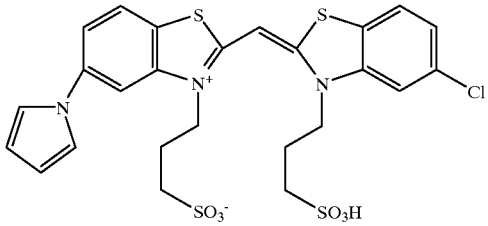

The invention has been described in detail with particular reference to certain preferred embodiments thereof, but it will be understood that variations and modifications can be effected within the spirit and scope of the invention.

What is claimed is:

1. An imaging element comprising a support having an image forming layer thereon and adhered to the back of said support a strippable polymer sheet that when removed has an adhesive layer thereon wherein said strippable sheet comprises a substantially transparent sheet having a border design.

2. The imaging element of claim 1 wherein said support after removal of said strippable polymer sheet has an exposed writable surface.

3. The imaging element of claim 1 wherein after said strippable polymer sheet has been removed an adhesive layer remains on said imaging element.

4. The imaging element of claim 1 wherein said strippable sheet is provided with a matte surface on the side opposite from said adhesive.

5. The imaging element of claim 1 wherein said support comprises a laminated support comprising a paper having a biaxially oriented polyolefin sheet laminated to each side.

6. The imaging element of claim 1 wherein said strippable sheet comprises a polyolefin or polyester sheet.

7. The imaging element of claim 1 wherein said strippable sheet comprises a substantially transparent sheet having oxygen barrier property of less than 2 $cc/m^2/atm/day$.

8. The imaging element of claim 1 wherein said support after stripping exposes indicia.

9. The imaging element of claim 1 wherein said strippable sheet comprises ultraviolet absorbers.

10. The imaging element of claim 1 wherein said strippable sheet comprises optical brighteners.

11. A method of forming a protected image comprising providing an imaging element comprising a support having an image thereon and adhered to the back of said support a strippable polymer sheet that when removed has an adhesive layer thereon, stripping said strippable polymer sheet and adhering the stripped sheet to the top of said image.

12. The method of forming a protected image of claim 11 comprising providing a strippable polymer sheet that has a border design.

13. The method of claim 11 wherein said support surface exposed after stripping of said strippable sheet is writable.

14. The method of claim 11 wherein said strippable sheet has an oxygen permeability of less than 1 $cc/m^2/atm/day$.

15. The method of claim 11 wherein said strippable sheet comprises ultraviolet absorbers.

16. The method of claim 11 wherein said strippable sheet comprises optical brighteners.

17. A method of forming an image comprising providing an imaging element comprising a support having an image thereon and adhered to the back of said support a strippable polymer sheet that when removed has an adhesive layer thereon, and stripping said strippable polymer wherein said strippable polymer sheet has indicia on the top side.

18. The method of claim 17 wherein the back of said support is provided with indicia which is exposed when said strippable polymer sheet is stripped from said support.

19. The method of claim 18 wherein said strippable polymer sheet is substantially opaque.

20. The method of claim 18 wherein when said strippable polymer sheet is removed, a magnetically readable indicia is exposed.

21. The method of claim 18 wherein said image comprises dyes formed from dye forming couplers.

22. The method of claim 18 wherein said image comprises dyes formed from ink jet, thermal dye transfer, or electrophotography.

23. An imaging element comprising a support having an image forming layer thereon and adhered to the back of said support a strippable polymer sheet that when removed has an adhesive layer thereon wherein said strippable sheet comprises a substantially transparent sheet having oxygen barrier property of less than 2 $cc/m^2/atm/day$.

24. The imaging element of claim 23 wherein said support after removal of said strippable polymer sheet has an exposed writable surface.

25. The imaging element of claim 26 wherein said strippable sheet is provided with a matte surface on the side opposite from said adhesive.

26. The imaging element of claim 23 wherein said support comprises a laminated support comprising a paper having a biaxially oriented polyolefin sheet laminated to each side.

27. The imaging element of claim 23 wherein said strippable sheet comprises a polyolefin or polyester sheet.

28. The imaging element of claim 23 wherein said strippable sheet comprises a substantially transparent sheet having a border design.

29. The imaging element of claim 23 wherein said support after stripping exposes indicia.

30. The imaging element of claim 23 wherein said strippable sheet comprises ultraviolet absorbers.

31. A method of forming an image comprising providing an imaging element comprising a support having an image thereon and adhered to the back of said support a strippable polymer sheet that when removed has an adhesive layer thereon, and stripping said strippable polymer wherein the back of said support is provided with indicia which is exposed when said strippable polymer sheet is stripped from said support and said strippable polymer sheet is substantially opaque.

32. The method of claim 31 wherein said strippable polymer sheet has indicia on the top side.

33. The method of claim 31 wherein when said strippable polymer sheet is removed, a magnetically readable indicia is exposed.

34. The method of claim 31 wherein said image comprises dyes formed from dye forming couplers.

35. The method of claim 31 wherein said image comprises dyes formed from ink jet, thermal dye transfer, or electrophotography.

* * * * *